United States Patent [19]

Suimon et al.

[11] Patent Number: 5,052,972

[45] Date of Patent: Oct. 1, 1991

[54] DRIVE DEVICE FOR TOY AUTOMOBILE

[75] Inventors: Yoshio Suimon; Tsuneo Hanzawa, both of Tokyo, Japan

[73] Assignee: Kabushiki Kaisha Hanzawa Corporation, Tokyo, Japan

[21] Appl. No.: 556,532

[22] Filed: Jul. 20, 1990

[30] Foreign Application Priority Data

Oct. 5, 1989 [JP] Japan ..... 1-258843

[51] Int. Cl.[5] ..... A63H 29/00; A63H 18/00; A63H 29/24; A63F 9/14

[52] U.S. Cl. ..... 446/429; 446/435; 446/444; 446/463; 273/86 R

[58] Field of Search ..... 446/429, 430, 431, 435, 446/440, 444, 445, 448, 449, 462, 463; 273/86 R

[56] References Cited

U.S. PATENT DOCUMENTS

| | | | |
|---|---|---|---|
| 3,559,335 | 2/1971 | See | 446/429 |
| 3,590,524 | 7/1971 | Beny | 446/429 |
| 3,636,651 | 1/1972 | Lohr et al. | 446/429 |
| 3,712,615 | 1/1973 | Staats et al. | 273/86 R |
| 3,812,933 | 5/1974 | Darda | 446/462 X |
| 4,070,024 | 1/1978 | Hamano | 446/429 X |
| 4,087,935 | 5/1978 | Edmisson et al. | 446/429 X |
| 4,116,084 | 9/1978 | Masuda | 446/463 X |
| 4,174,587 | 11/1979 | Morin et al. | 446/429 X |
| 4,188,748 | 2/1980 | Rich et al. | 446/430 |

FOREIGN PATENT DOCUMENTS

| | | | |
|---|---|---|---|
| 2033595 | 8/1971 | Fed. Rep. of Germany | 446/429 |
| 529892 | 2/1955 | Italy | 446/429 |
| 8204431 | 6/1984 | Netherlands | 446/462 |

*Primary Examiner*—Mickey Yu
*Assistant Examiner*—D. Neal Muir
*Attorney, Agent, or Firm*—Ladas & Parry

[57] ABSTRACT

A drive device for a toy automobile includes a casing open at front and rear ends thereof and covering a path of travel, a flywheel rotatably supported on the casing for coming into abutting contact with an upper surface of a toy automobile at a prescribed position on the path of travel, an operating member axially slidably supported on the casing and having a push-button portion protruding externally of the casing and urged outwardly by a return spring, a pinion turned while in mesh with a rack provided on the operating member and extending axially thereof, and a gear speed-up mechanism incorporating a one-way clutch and interposed between the pinion and the flywheel for rotating the flywheel in a direction which propels the toy automobile forward only when the operating member is pushed inward.

10 Claims, 3 Drawing Sheets

DRIVE DEVICE FOR TOY AUTOMOBILE

BACKGROUND OF THE INVENTION

This invention relates to a drive device for applying a propulsive force to a toy automobile not having motive power.

An example of such a drive device for a toy automobile is disclosed in Japanese Patent Publication (KOKOKU) No. 61-48385. The device includes a thrust member actuated by employing the spring force of a spring as a driving source. When the thrust member is actuated, it propels the toy automobile forward by pushing forward a portion of the car body of the toy automobile placed at a starting position. There is also a drive device in which a motor is driven using a battery such as a dry cell instead of a spring, whereby the thrust member is actuated to propel the toy automobile.

The abovementioned conventional drive device for a toy automobile using the spring as the driving source is monotonous to operate and the propulsive force obtained by the manner of operation lacks change. A user will not find such a toy automobile very interesting. The drive device using the motor as the driving force not only has the same problems as the drive device using the spring but also is expensive to produce owing to the need for the motor. In addition, since the battery is an expendable article, expense is entailed during use.

SUMMARY OF THE INVENTION

An object of the present invention is to provide an inexpensive drive device, which does not use a battery and a motor, for an interesting toy automobile not having motive power, in which a propulsive force can be sufficiently applied to the toy automobile by a manual operation and is capable of being varied significantly by the manner of operation.

According to the present invention, the foregoing object is attained by providing a drive device for a toy automobile, comprising a casing open at front and rear ends thereof and covering a path of travel, a flywheel rotatably supported on the casing for coming into abutting contact with an upper surface of a toy automobile at a prescribed position on the path of travel, an operating member axially slidably supported on the casing and having a push-button portion protruding externally of the casing and urged outwardly by a return spring, a pinion turned while in mesh with a rack provided on the operating member and extending axially thereof, and a gear speed-up mechanism incorporating a one-way clutch and interposed between the pinion and the flywheel for rotating the flywheel in a direction which propels the toy automobile forward only when the operating member is pushed inward.

In operation, the user presses down on the push-button portion protruding from the casing. When this is done, the operating member is pressed inward against the spring force of the return spring, as a result of which the pinion is reversely rotated by the rack provided on the operating member. Owing to the reverse rotation of the pinion, the one way clutch is engaged so that the reverse rotation of the pinion is speeded up by the gear speed-up mechanism and then transmitted to the flywheel to rotate it at high speed. When the user releases the push-button portion, the operating member is moved in the direction opposite the inward direction by the spring force of the return spring and is thereby restored to its original outwardly protruding attitude.

At such time the pinion meshing with the rack provided on the operating member rotates in the reverse direction, but the one-way clutch is disengaged at the time of this reverse rotation. As a consequence, a reverse rotating force is not transmitted from the clutch to the flywheel side, and hence the flywheel continues rotating. After the operating member has been restored, the push-button portion of the operating member is pressed again, thereby reversely rotating the pinion and transmitting the rotating force having this direction to the flywheel, as described above.

By repeating this operation of pressing the operating member and allowing it to be restored by the return spring a number of times, the flywheel attains a high-speed rotating state in which rotational energy is stored up. If the toy automobile is now introduced from the rear of the path of travel to the position at which the flywheel is rotating, the flywheel abuts against the upper surface of the toy automobile, such as its roof. Owing to the frictional engagement between the flywheel and this upper surface, a propulsive force is applied to the toy automobile to thrust it forward or accelerate it.

In this case, the propulsive force applied to the toy automobile will differ depending upon the number of times the operating member is pressed, the interval between presses and the size of each stroke. The propulsive force will differ also depending upon the timing at which the toy automobile is introduced to the position of the flywheel. Accordingly, the propulsive force will differ not only depending upon the operation performed by the particular operator but also depending upon the particular operation performed by one and the same operator. As a result, the drive device of the present invention is more interesting than that of the prior art and can be produced inexpensively since a motor and a battery are not used. In addition, no expenses are incurred during use.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENT

A preferred embodiment of the present invention will now be described in detail with reference to the drawings.

Figure 1:
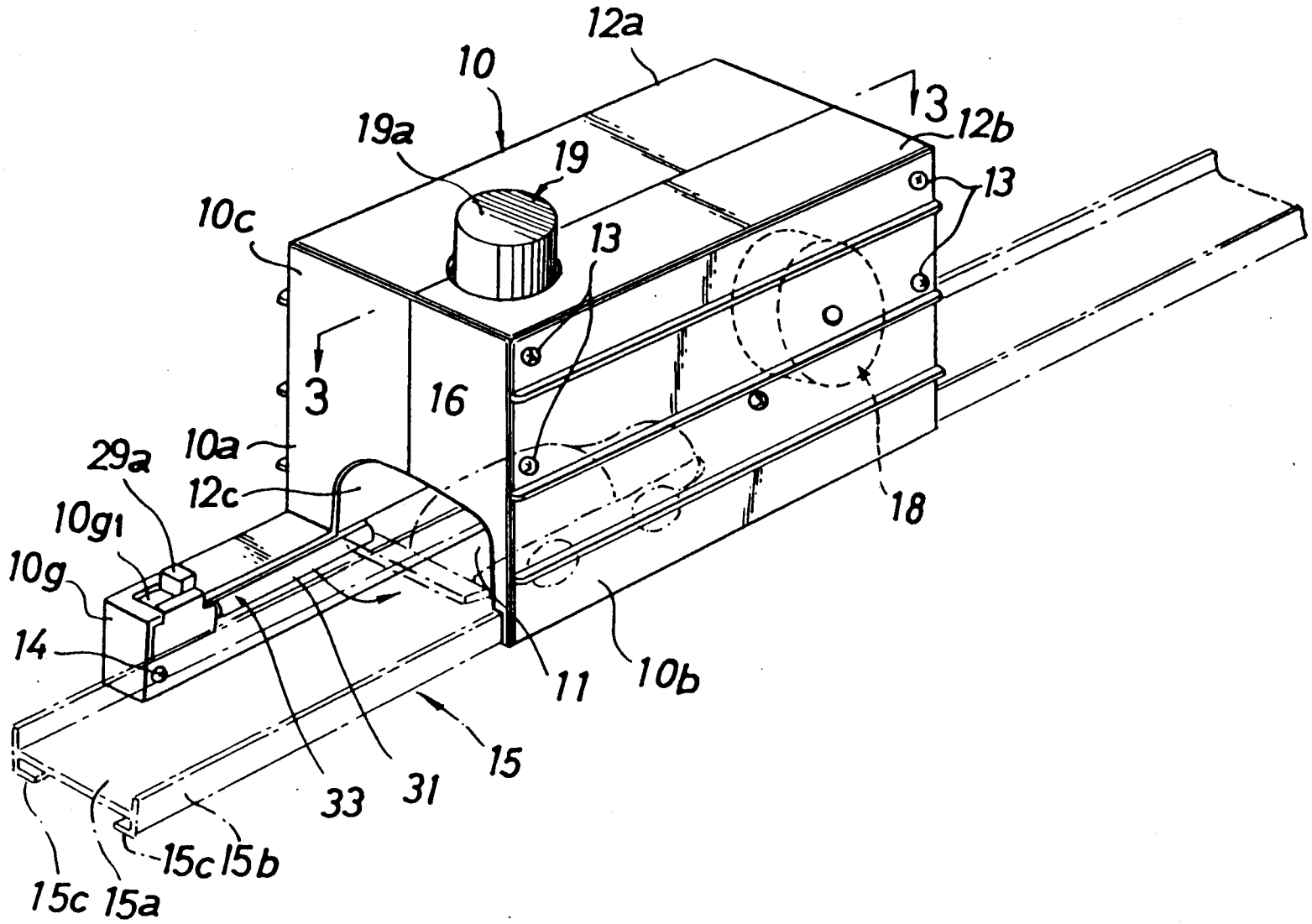
FIG. 1 is a perspective view illustrating an embodiment of a drive device for a toy automobile according to the present invention.
Figure 2:
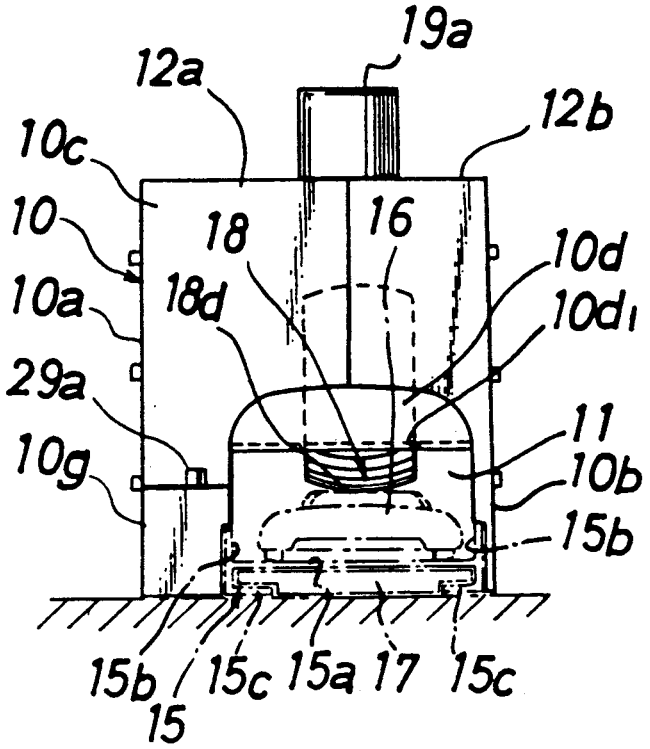
FIG. 2 is a back view of the drive device.
Figure 3:
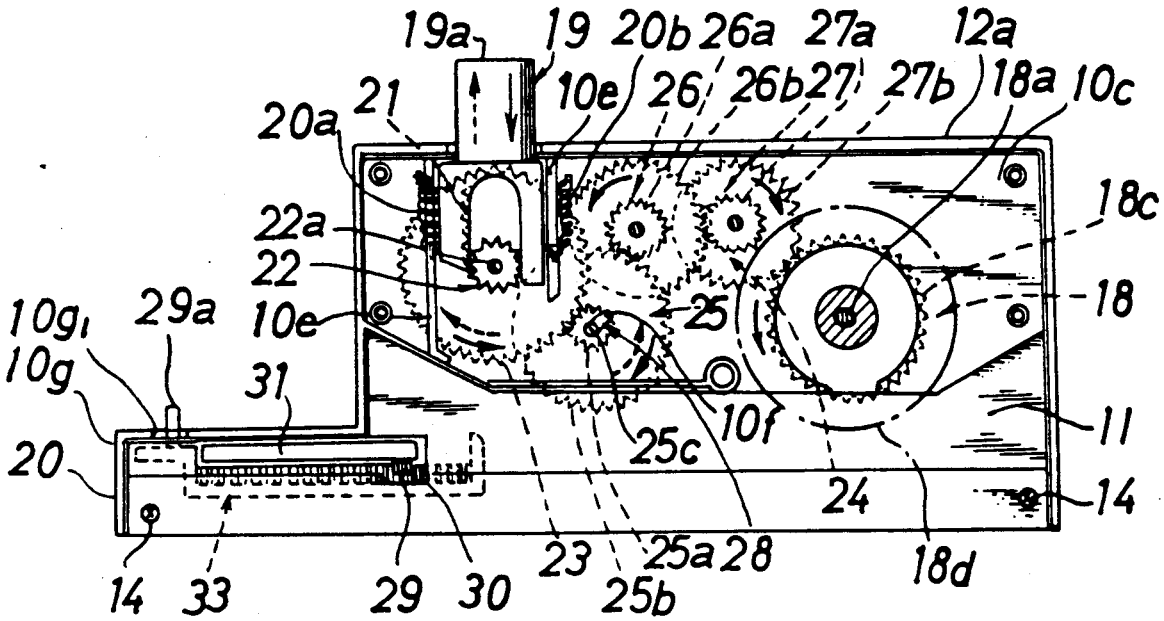
FIG. 3 is a sectional view taken along line 3—3 of FIG. 1.

As shown in FIGS. 1 and 2, a casing 10 has side wall portions 10*a*, 10*b* upstanding from left and right sides of a path of travel 11, and an upper connecting portion 10*c* connecting the upper ends of the side wall portions 10*a*, 10*b* so as to form the path of travel 11 into a tunnel-shaped configuration. The casing 10 comprises left and right halves which are plastic molded parts 12*a*, 12*b* secured together by screws 13. An inner wall plate 12c is secured to the molded part 12a by screws 14, as shown in FIG. 3, and the side wall portion 10a and upper connecting portion 10c are formed to have mutually communicating hollow portions.

A track member 15 is fitted between the side wall portions 10a, 10b and is retained by the lower parts of these wall portions. The track member 15 extends longitudinally of the path of travel 11 of casing 10 and includes a support plate 15a serving as a surface of travel for a toy automobile 16 not having motive power, and side plates 15b provided on left and right sides of the support plate 15a and formed integral with the support plate 15a at right angles thereto. The upper portions of the side plates 15b protrude above the support plate 15a, and the lower portions thereof protrude below the support plate 15a. Flange portions 15c protrude toward each other from opposing side faces of the side plates 15b on the lower portions thereof. A reinforcing member 17 is fixedly fitted into the lower portion of the support plate 15a at a suitable position, such as below the path of travel 11.

Figure 5:
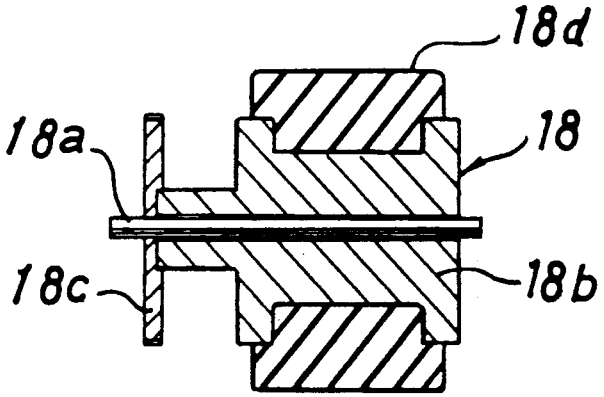
FIG. 5 is a sectional view of a flywheel.
Figure 4:
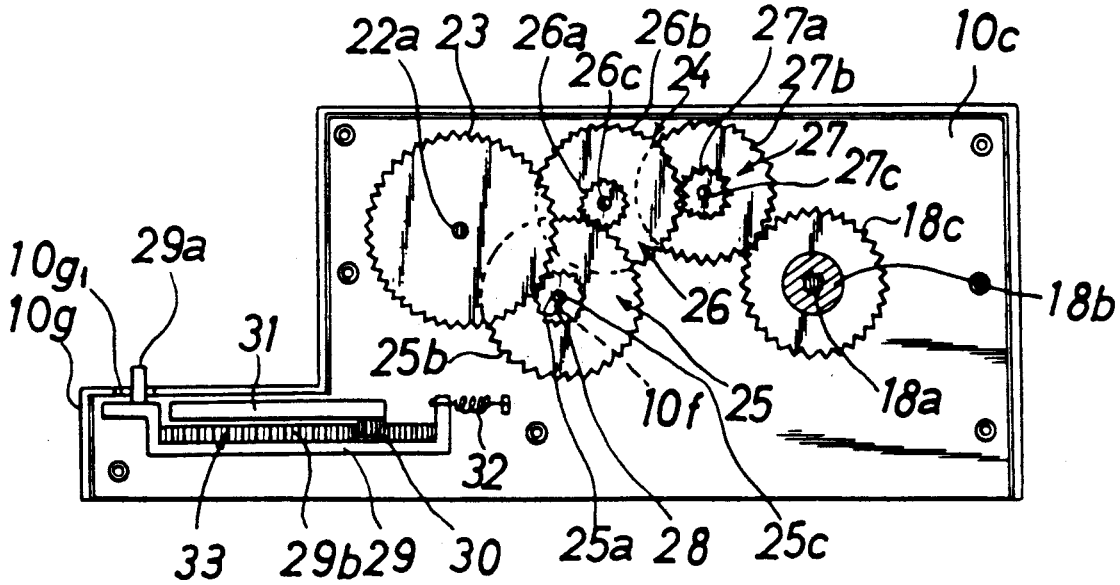
FIG. 4 is a side view showing a gear speed-up mechanism and an auxiliary thrust mechanism.

A flywheel 18 is arranged at a predetermined position at the front end of the casing 10. As shown in FIGS. 3 through 5, the flywheel 18 includes a shaft 18, a weighted cylinder 18b fixedly fitted onto the shaft 18, a driven gear 18c secured to one end face of the weighted cylinder 18b, and a tire 18d, which is made of a resilient, comparatively soft, flexible material such as rubber, fixedly fitted onto the outer circumference of the weighted cylinder 18b. The outer circumferential surface of the tire 18d is provided with treads so as to obtain a prescribed frictional force.

The weighted cylinder 18b, driven gear 18c and tire 18d are arranged with their centers in coincidence with the center of the shaft 18a. The shaft 18a is axially supported on the side wall portions 10a, 10b of the casing 10, and the major portion of the flywheel 18 is received within the upper connecting portion 10c of the casing 10. The lower portion of the flywheel 10 projects slightly into the path of travel 11 from a window $10d_1$ provided in a lower wall 20d obtained by bending upward at an incline the front and rear ends of the connecting portion 10c.

An operating member 19 passing vertically through the upper wall of the connecting portion 10c is arranged on the rear portion of the casing 10. The operating member 19 has a push-button portion 19a protruding from above the casing 10. The operating member 19 is supported so as to be capable of sliding reciprocatively within a prescribed range in the vertical direction, namely axially of the operating member, along a guide portion 10e provided on the upper connecting portion 10c of the casing 10. The operating member 19 is suspended from the casing by return springs 20a, 20b and is urged upward, namely in the projecting direction, by the springs 20a, 20b.

A rack 21 is provided along the operating member 19 axially thereof and is arranged within the upper connecting portion 10c. Meshing with the rack 21 is a pinion 22. A drive gear 23 having a diameter larger than that of the pinion 22 is secured to the pinion 22 in coaxial relation therewith. A gear speed-up mechanism 24 which includes the drive gear 23 and the driven gear 18c is interposed between these gear.

The gear speed-up mechanism 24 is provided with first, second and third intermediate gears 25, 26, 27 that are secured to the same shafts as small gears 25a, 26a, 27a and large gears 25b, 26b, 27b, respectively.

The small gear 25a of the first intermediate gear 25 meshes with the drive gear 23, the small gears 26a, 27a on the drive side mesh successively with the large gears 25b, 26b on the driven side, and the large gear 27b of the third intermediate gear 27 meshes with the driven gear 18c, which is of approximately the same diameter. A common shaft 22a of the pinion 22 and drive gear 23, and shafts 26c, 27c of the second and third intermediate gears 26, 27 are axially supported on the casing 10. A shaft 25c of the first intermediate gear 25 is turnably and movably supported in inclined slots 10f (only one of which is shown) formed in the side wall portion 10a and inner wall plate 10c of the casing 10 so as to oppose each other, and the shaft 25c of the first intermediate gear 25 is disposed below a portion intermediate the common shaft 22a and the shaft 26c of the second intermediate gear 26. Thus, a one-way clutch 28 is incorporated in the gear speed-up mechanism 24.

When the operating member 19 is pressed, the drive gear 23 is rotated reversely (counter-clockwise) in the direction of the solid-line arrow in FIG. 3 so that the drive gear 23 is meshed with the small gear 25a of the first intermediate gear 25, thereby moving the shaft 25c of the first intermediate gear 25 obliquely upward along the inclined slots 10f and meshing the large gear 25b of the first intermediate gear 25 with the small gear 26a of the second intermediate gear 26, as a result of which rotational motion is transmitted from the large gear 25b to the small gear 26a. Thus, the clutch 28 assumes the engaged state. When the operating member 19 is released and is restored upwardly in the direction of the broken-line arrow in FIG. 3 by the return springs 20a, 20b, the drive gear 23 rotates reversely. Owing to the meshing engagement between this gear and the small gear 25a of the first intermediate gear 25, the shaft 25c of the first intermediate gear 25 moves obliquely downward along the inclined slots 10f. As a result, the drive gear 23 rotates forward and the first intermediate gear 25 meshing therewith merely rotates reversely. Thus, the clutch 28 assumes the disengaged state, in which rotational force is not transmitted from the first intermediate gear 25 to the second intermediate gear 26. The rack 21, pinion 22 and gear speed-up mechanism 24 are accommodated inside the upper connecting portion 10c of the casing 10.

The lower end portion of the casing 10 on one side thereof protrudes to the rear to form a projecting portion 10g on which a rack rod 29 is supported so as to be slidable back and forth. A slot $10g_1$ is provided in the upper surface of the projecting portion 10g. A knob 29a protruding from the rear end portion of the rack rod 29 is engaged with the slot $10g_1$ and is capable of moving back and forth therealong within a fixed range. The knob 29a projects upwardly from the slot $10g_1$. A longitudinal pinion 30 meshing with a rack 29b provided on the rack rod 29 is fixedly secured to a base end portion of an auxiliary thrush arm 31, and the pinion 30 is pivotally secured to the projecting portion 10g along with the base end of the arm 31. The front end of the rack rod 29 is connected to the casing 10 by a tension spring 32.

The auxiliary propulsion mechanism 33 constructed as set forth above is such that when the user grasps the knob 29a by hand and retracts the rack rod 29 against the tension spring 32, the auxiliary thrust arm 31 is swung horizontally, owing to the engagement between the longitudinal pinion 30 and the rack 29b of the rack rod 29, and is thus caused to project above the track member 15 near the rear end of the tunnel-shaped path of travel 11 until it is perpendicular to the sides of the track member. As a result, by placing the toy automobile 16 on the support plate 15*a* of the track member 15 beforehand, the toy automobile will be pushed from the rear owing to the horizontal swinging motion of the auxiliary thrust arm 31 and therefore can be thrust forwardly in such a manner that its upper surface will come into contact with the outer circumferential surface of the flywheel 18. When the user releases the knob 29*a*, the rack rod 29 is moved forwardly by the spring force of the tension spring 32 so that the auxiliary thrust arm 31 is restored by being turned reversely. Owing to such restoration, the auxiliary thrust arm 31 is withdrawn from the track member 15 and is made substantially flush with the side wall plate 12*c* of the casing 10. The auxiliary thrust arm 31 is held in this state.

Use of the toy automobile drive device constructed as set forth above will now be described.

When the user presses down on the push-button portion 19*a* of the operating member projecting upwardly from the casing 10, the operating member 19 recedes against the spring force of the return springs 20*a*, 20*b*, as shown by the solid-line arrow in FIG. 3, so that the pinion 22 is turned reversely (counter-clockwise) in the direction of the solid-line arrow in FIG. 3 by the rack 21 provided on the operating member 19. As a result of the reverse rotation of pinion 22, the one-way clutch 28 is engaged in the manner described above so that the reverse rotation of the pinion 22 is speeded up by the gear speed-up mechanism 25 and then transmitted to the flywheel 18, thereby rotating the latter in the forward direction of the toy automobile 16. When the user releases push-button portion 19*a*, the operating member 19 is moved upwardly to the projecting state, as indicated by the broken-line arrow in FIG. 3, by the spring force of the return springs 20*a*, 20*b*, and is thus restored to the position it occupied before being pressed. At such time the pinion 22 and the drive gear 23 rotate in the reverse direction owing to the meshing engagement between the pinion 22 and the rack 21 provided on the operating member 19. However, the one-way clutch 28 is disengaged at the time of this reverse rotation. As a consequence, a reverse rotating force is not transmitted from the second intermediate gear 26 of the gear speed-up mechanism 24 to the flywheel 18, and hence the flywheel 18 continues rotating in the direction of the solid-line arrow in FIG. 3. After the operating member 19 has been restored, the push-button portion 19*a* thereof is pressed again, thereby reversely rotating the pinion 22 and transmitting the rotating force having this direction to the flywheel 18, as described above.

By repeating this operation of pressing the operating member 19 and allowing it to be restored by the return springs 20*a* , 20*b* a number of times, the flywheel 18 attains a high-speed rotating state in which rotational energy is stored up. Under these conditions, the toy automobile 16 placed by the user on the support plate 15*a* of the track member 15 at the rear of the path of travel 11 is introduced to the position of the rotating flywheel 18 by being pushed forwardly by hand or by operating the auxiliary propulsion mechanism 33 to thrust the toy automobile forwardly by the auxiliary thrust arm 31. When this is done, the outer circumferential surface of the tire 18*d* of flywheel 18 comes into contact with the upper surface of the roof of the toy automobile while undergoing slight elastic deformation. Owing to this frictional engagement, a propulsive force is applied to the toy automobile 16 to propel it forward. A plurality of users can engage in competition by measuring the distance traveled by the propelled toy automobile 16 or by measuring circuit time if track member 15 is made an endless loop and the propelled toy automobile is made to travel along the loop. The track member 15 can be provided with an incline to test climbing force in competition. Alternatively, the endless track member 15 can be made a loop on which the toy automobile is made to travel, during which time the flywheel 18 can be made to store up energy again by operating the operating member 19. The toy automobile will be thrust forwardly again when it comes into contact with the outer circumferential surface of the flywheel 18. By thus making the toy automobile 16 circuit the track member 19 a plurality of times, users can compete in terms of measured circuit time.

Furthermore, a plurality of the drive devices of this embodiment can be arrayed side by side and a plurality of toy automobiles can be raced against one another by operating the drive devices simultaneously.

The greater the number of times the operating member is pressed, the shorter the interval between presses and the greater the pressing distance (stroke), the greater the amount of rotational energy that will be stored up in the flywheel 18 and, hence, the larger the propulsive force that will be applied to the toy automobile. Conversely, the smaller the abovementioned quantities, the smaller the force will be. Further, the shorter the time between the last depression of the push-button portion 19*a* and the establishment of contact between the toy automobile 16 and the flywheel 18, the greater the propulsive force will be. Therefore, if the above operation is performed a plurality of times not only by different persons but also by the same person, the propulsive force will differ each time. Accordingly, it is necessary for the user to contrive the best manner of manual operation, and the toy therefore will hold the interest of users such as small children and juveniles.

It should be noted that the auxiliary propulsion mechanism and track member are not absolutely required in the present invention, and that the number of intermediate gears in the gear speed-up mechanism and the construction of the one-way clutch can be changed as desired and are not limited to those of the illustrated embodiment. Furthermore, the number of return springs for restoring the operating member to the projecting state and the axial direction of the operating member also can be changed as desired. By incorporating gears for converting direction, the push-button portion of the horizontal operating member can be made to project from the side face of the casing.

A number of advantages are obtained by virtue of the above-described construction of the toy automobile drive device according to the present invention. Specifically, by repeating the operation of pressing the operating member and allowing it to be restored by the return spring, rotational energy is stored up in the flywheel. Then, by causing the toy automobile to contact the rotating flywheel, a propulsive force is applied to the toy automobile, which is thereby propelled or accelerated forwardly. The propulsive force thus applied to the toy automobile therefore differs depending upon the number of times the operating member is pressed, the interval between presses and the size of each pressing stroke, and also depending upon the timing at which the toy automobile is introduced to the flywheel. Accordingly, the propulsive force will differ not only depending upon the operation performed by the particular operator but also depending upon the particular operation performed by one and the same operator. As a result, the drive device of the present invention is more interesting than that of the prior art and can be produced inexpensively since a motor and a battery are not used. In addition, no expenses are incurred during use.

As many apparently widely different embodiments of the present invention can be made without departing from the spirit and scope thereof, it is to be understood that the invention is not limited to the specific embodiments thereof except as defined in the appended claims.

What is claimed is:

1. A drive device for a toy automobile, comprising:

a casing open at front and rear ends thereof and covering a path of travel;

a flywheel rotatably supported on said casing for coming into abutting contact with an upper surface of a toy automobile at a prescribed position on the path of travel;

an operating member axially slidably supported on said casing and having a rack extending axially thereof, and a push-button portion protruding externally of said casing and urged outwardly by a return spring;

a pinion turned while in mesh with said rack and extending axially thereof; and a gear speed-up mechanism incorporating a one-way clutch and interposed between said pinion and said flywheel for rotating said flywheel in a direction which propels the toy automobile forward only when said operating member is pushed inward.

2. The drive device according to claim 1, wherein said casing has side wall portions upstanding from left and right sides of the path of travel, and an upper connecting portion connecting said side wall portions to form said path of travel into a tunnel-shaped configuration, the push-button portion of said operating member projecting upwardly from an upper face of said connecting portion, a lower portion of said flywheel rotatably supported on said connecting portion protruding slightly into said path of travel below said connecting portion, and said pinion and gear speed-up mechanism being accommodated inside said connecting portion.

3. The drive device according to claim 1, wherein said one-way clutch has a plurality of intermediate gears interposed between said pinion and a driven gear fixed coaxially in relation to said flywheel, a shaft of one of the intermediate gears is turnably and movably supported in inclined slots provided in said casing, and said intermediate gear is moved by meshing with a gear on the pinion side only when said operating member is pressed, with rotation being transmitted from this gear to the intermediate gear.

4. The drive device according to claim 1, wherein said flywheel includes a shaft, a weighted cylinder fixedly fitted onto the shaft, a driven gear secured to one end face of the weighted cylinder and meshing with a gear of the gear speed-up mechanism, and a tire, which is made of a resilient material, fixedly fitted onto an outer circumference of said weighted cylinder.

5. The drive device according to claim 2, further comprising an auxiliary propulsion mechanism which includes an auxiliary thrust arm having a base end pivotally supported on a side wall of said casing so that said auxiliary thrust arm is capable of swinging horizontally to project into the path of travel, the base end being arranged near a rear end of the tunnel-shaped path of travel and being provided with an auxiliary pinion, a rack rod being supported on said side wall so as to be movable back and forth, said rack rod being provided with a rack, said rack being meshed with said auxiliary pinion, and a tension spring urging said rack rod forwardly being connected to said side wall.

6. The drive device according to claim 2, wherein said one-way clutch has a plurality of intermediate gears interposed between said pinion and a driven gear fixed coaxially in relation to said flywheel, a shaft of one of the intermediate gears is turnably and movably supported in inclined slots provided in said casing, and said intermediate gear is moved by meshing with a gear on the pinion side only when said operating member is pressed, with rotation being transmitted from this gear to the intermediate gear.

7. The drive device according to claim 2, wherein said flywheel includes a shaft, a weighted cylinder fixedly fitted onto the shaft, a driven gear secured to one end face of the weighted cylinder and meshing with a gear of the gear speed-up mechanism, and a tire, which is made of a resilient material, fixedly fitted onto an outer circumference of said weighted cylinder.

8. The drive device according to claim 3, wherein said flywheel includes a shaft, a weighted cylinder fixedly fitted onto the shaft, a driven gear secured to one end face of the weighted cylinder and meshing with a gear of the gear speed-up mechanism, and a tire, which is made of a resilient material, fixedly fitted onto an outer circumference of said weighted cylinder.

9. The drive device according to claim 3, further comprising an auxiliary propulsion mechanism which includes an auxiliary trust arm having a base end pivotally supported on a side wall of said casing so that said auxiliary thrust arm is capable of swinging horizontally to project into the path of travel, the base end being arranged near a rear end of the tunnel-shaped path of travel and being provided with an auxiliary pinion, a rack rod being supported on said side wall so as to be movable back and forth, said rack rod being provided with a rack, said rack being meshed with said auxiliary pinion, and a tension spring urging said rack rod forwardly being connected to said side wall.

10. The drive device according to claim 4, further comprising an auxiliary propulsion mechanism which includes an auxiliary thrust arm having a base end pivotally supported on a side wall of said casing so that said auxiliary thrust arm is capable of swinging horizontally to project into the path of travel, the base end being arranged near a rear end of the tunnel-shaped path of travel and being provided with an auxiliary pinion, a rack rod being supported on said side wall so as to be movable back and forth, said rack rod being provided with a rack, said rack being meshed with said auxiliary pinion, and a tension spring urging said rack rod forwardly being connected to said side wall.

* * * * *